US010524034B2

(12) United States Patent
Tong

(10) Patent No.: US 10,524,034 B2
(45) Date of Patent: Dec. 31, 2019

(54) DEVICES HAVING A HOUSING AND A FOOT

(71) Applicant: RAZER (ASIA-PACIFIC) PTE. LTD., Singapore (SG)

(72) Inventor: Ien Yu Tong, Johor (MY)

(73) Assignee: RAZER (ASIA-PACIFIC) PTE. LTD., Singapore (SG)

( * ) Notice: Subject to any disclaimer, the term of this patent is extended or adjusted under 35 U.S.C. 154(b) by 0 days.

(21) Appl. No.: 15/521,814

(22) PCT Filed: Oct. 27, 2014

(86) PCT No.: PCT/SG2014/000503
§ 371 (c)(1),
(2) Date: Apr. 25, 2017

(87) PCT Pub. No.: WO2016/068789
PCT Pub. Date: May 6, 2016

(65) Prior Publication Data

US 2017/0251288 A1 Aug. 31, 2017

(51) Int. Cl.
*H04R 9/06* (2006.01)
*H04R 1/02* (2006.01)
*H04R 1/32* (2006.01)

(52) U.S. Cl.
CPC ..... *H04R 1/026* (2013.01); *H04R 1/323* (2013.01); *H04R 1/02* (2013.01); *H04R 2201/025* (2013.01)

(58) Field of Classification Search
CPC ..... H04R 1/02; H04R 1/021; H04R 1/023; H04R 1/025; H04R 1/026; H04R 1/028;
(Continued)

(56) References Cited

U.S. PATENT DOCUMENTS 4,078,757 A * 3/1978 Waters ..... A47B 19/02 108/150
2003/0160138 A1 8/2003 Rawlings et al.
(Continued)

FOREIGN PATENT DOCUMENTS

JP 11289588 A * 10/1999
JP H11289588 A 10/1999
(Continued)

OTHER PUBLICATIONS

Extended European Search Report dated Jun. 1, 2018, 7 pages, for the corresponding European Patent Application No. 14905159.1.
(Continued)

*Primary Examiner* — Leshui Zhang
(74) *Attorney, Agent, or Firm* — Polsinelli PC

(57) ABSTRACT

According to various embodiments, a device may be provided. The device may include: a housing comprising a first engaging member; and a foot comprising a second engaging member. The first engaging member and the second engaging member may be configured to engage in at least one of a first way or a second way. When the first engaging member and the second engaging member engage in the first way, the housing may have a first orientation relative to a pre-determined portion of the foot. When the first engaging member and the second engaging member engage in the second way, the housing may have a second orientation relative to the pre-determined portion of the foot.

12 Claims, 7 Drawing Sheets

(58) Field of Classification Search
CPC ..... H04R 1/2819; H04R 1/2826; H04R 1/30; H04R 1/323; H04R 1/44; H04R 2201/02; H04R 2201/025; H04R 2201/029; H04R 2420/05; H04R 2499/15; H04R 5/02; A47B 13/023; A47B 23/042; F16M 11/10; F16M 11/22; F16M 13/00; F16M 2200/02; F16M 2200/08; H04N 21/485
USPC ..... 381/332–336, 182, 385–389; 248/688, 248/690, 691, 693, 673, 676, 677, 678, 248/681, 188.1, 188.8, 371, 156, 370, 248/398, 217.2
See application file for complete search history.

(56) References Cited

U.S. PATENT DOCUMENTS

| | | | | |
|---|---|---|---|---|
| 2004/0190238 | A1 | 9/2004 | Hubbard | |
| 2011/0147560 | A1* | 6/2011 | Camarillo | A47B 13/023 248/371 |
| 2011/0243363 | A1 | 10/2011 | Yamaguchi | |
| 2011/0255730 | A1* | 10/2011 | Shibata | H04R 1/026 381/395 |
| 2012/0189156 | A1 | 7/2012 | Leung | |
| 2013/0343577 | A1 | 12/2013 | Waitzman, III et al. | |
| 2014/0151516 | A1 | 6/2014 | Liu | |

FOREIGN PATENT DOCUMENTS

| | | |
|---|---|---|
| JP | 2008-154084 A | 7/2008 |
| WO | WO 2012/014084 | 2/2012 |
| WO | WO 2013/162963 | 10/2013 |

OTHER PUBLICATIONS

Office Action (including English Translation) dated Aug. 1, 2019, for the corresponding Chinese Application No. 201480082985.5 in 15 total pages.

* cited by examiner

DEVICES HAVING A HOUSING AND A FOOT

TECHNICAL FIELD

Various embodiments generally relate to devices having a housing and a foot.

BACKGROUND

Different configurations of a device may be desired for different purposes. For example, it may be desired to provide a loudspeaker at various angles depending on the distance of the user from the loudspeaker. As such, there may be a need for a device allowing for various configurations.

SUMMARY OF THE INVENTION

According to various embodiments, a device may be provided. The device may include: a housing including a first engaging member; and a foot including a second engaging member. The first engaging member and the second engaging member may be configured to engage in at least one of a first way or a second way. When the first engaging member and the second engaging member engage in the first way, the housing may have a first orientation relative to a pre-determined portion of the foot. When the first engaging member and the second engaging member engage in the second way, the housing may have a second orientation relative to the pre-determined portion of the foot.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. The dimensions of the various features or elements may be arbitrarily expanded or reduced for clarity. In the following description, various embodiments of the invention are described with reference to the following drawings, in which.

DETAILED DESCRIPTION

Figure 1A:
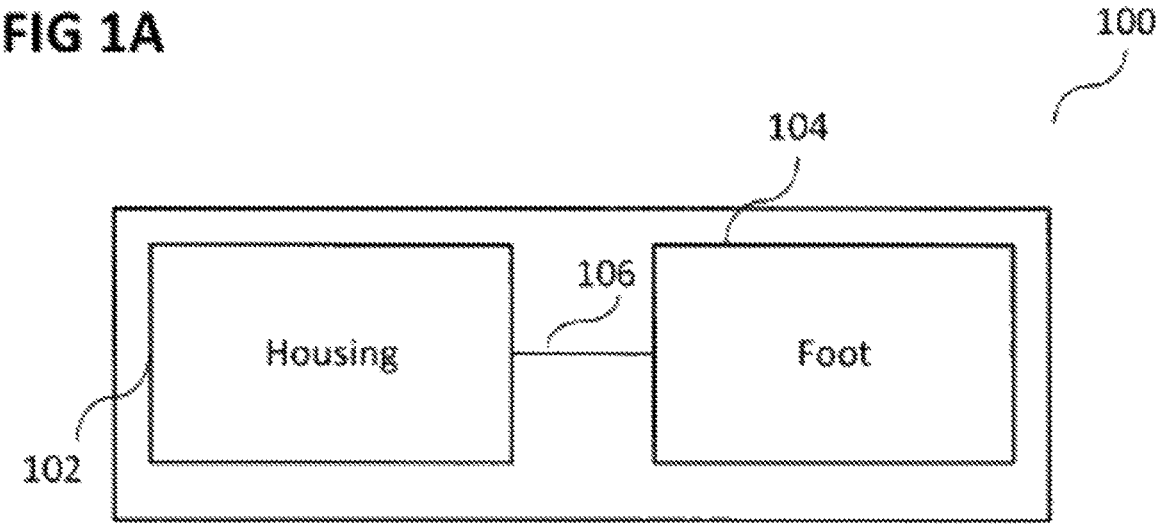
FIG. 1A and FIG. 1B show devices according to various embodiments.

The following detailed description refers to the accompanying drawings that show, by way of illustration, specific details and embodiments in which the invention may be practiced. These embodiments are described in sufficient detail to enable those skilled in the art to practice the invention. Other embodiments may be utilized and structural, and logical changes may be made without departing from the scope of the invention. The various embodiments are not necessarily mutually exclusive, as some embodiments can be combined with one or more other embodiments to form new embodiments.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The reference to any prior art in this specification is not, and should not be taken as an acknowledgement or any form of suggestion that the referenced prior art forms part of the common general knowledge in Australia (or any other country).

In order that the invention may be readily understood and put into practical effect, particular embodiments will now be described by way of examples and not limitations, and with reference to the figures.

Various embodiments are provided for devices, and various embodiments are provided for methods. It will be understood that basic properties of the devices also hold for the methods and vice versa. Therefore, for sake of brevity, duplicate description of such properties may be omitted.

It will be understood that any property described herein for a specific device may also hold for any device described herein. It will be understood that any property described herein for a specific method may also hold for any method described herein. Furthermore, it will be understood that for any device or method described herein, not necessarily all the components or steps described must be enclosed in the device or method, but only some (but not all) components or steps may be enclosed.

The term "coupled" (or "connected") herein may be understood as electrically coupled or as mechanically coupled, for example attached or fixed or attached, or just in contact without any fixation, and it will be understood that both direct coupling or indirect coupling (in other words: coupling without direct contact) may be provided.

Different configurations of a device may be desired for different purposes. For example, it may be desired to provide a loudspeaker at various angles depending on the distance of the user from the loudspeaker. As such, there may be a need for a device allowing for various configurations. For example, when using a loudspeaker for a personal computer (PC), the distance between the loudspeaker and the user may be short, and as such, a steeper angle may be provided compared to when the speaker is used for a gaming console, where usually the distance between the loudspeaker and the user is larger, and thus, a flater angle may be provided.

According to various embodiments, a foot or a plurality of feet for a device (for, example a speaker, for example a soundbar) may be provided, which has the ability to adjust or vary the angle of the speaker through the use of a removable foot or removable feet that adjusts or adjust the angle of the soundbar when turned 180 degrees.

FIG. 1A shows a device 100 according to various embodiments. The device 100 may include a housing 102. The housing 102 may include a first engaging member (not shown in FIG. 1A). The device 100 may further include a foot 104. The foot 104 may include a second engaging member (not shown in FIG. 1A). The first engaging member and the second engaging member may be configured to engage (for example with each other) in a first way or in a second way. As such, the housing 102 and the foot 104 may be coupled, like illustrated by line 106. When the first engaging member and the second engaging member engage in the first way, the housing 102 may have a first orientation relative to a pre-determined portion of the foot 104. When the first engaging member and the second engaging member engage in the second way, the housing 102 may have a second orientation relative to the pre-determined portion of the foot 104.

In other words, according to various embodiments, by connecting a foot to the housing in different ways (for example in different orientations), different orientations of the housing 102 with respect to the foot 104 may be achieved.

According to various embodiments, the first engaging member and the second engaging member engaging in the first way may include or may be the first engaging member and the second engaging member engaging in a first relative orientation. Likewise, the first engaging member and the second engaging member engaging in the second way may include or may be the first engaging member and the second engaging member engaging in a second relative orientation.

According to various embodiments, in the second relative orientation, the foot 102 may be rotated by about at least substantially 180 degrees compared to the first relative orientation. The foot 102 may have a lower surface on which the device 100 including the foot 102 stands (as such, the name "foot" may be used). The lower surface of the foot 102 in the first relative orientation, when standing on an at least substantially planar surface, may be in a plane of the at least substantially planar surface. Likewise, the lower surface of the foot 102 in the second relative orientation, when standing on an at least substantially planar surface, may be in a plane of the at least substantially planar surface. However, the housing 102 may have a first orientation relative to the pre-determined portion of the foot 104 which may be different from a second orientation relative to the pre-determined portion of the foot 104, and as such, the overall three-orientation of the housing 102, when resting on the foot 104, may be different depending on the first relative orientation and the second relative orientation.

According to various embodiments, the first engaging member may include or may be or may be included in a recess, and the second engaging member may include or may be or may be included in a protrusion.

According to various embodiments, the recess may be larger than the protrusion. According to various embodiments, the foot 104 may be held in any position (no matter whether attached to the housing 102 in the first way or the second way), and may be aligned by a circular recess near the first engaging member of the housing 102.

According to various embodiments, the recess may be configured to receive the protrusion in at least one of the first way or the second way.

According to various embodiments, the recess may be configured to receive the protrusion at least substantially completely in the first way, and furthermore, the recess may be configured to receive the protrusion at least substantially completely in the second way.

According to various embodiments, the first engaging member may include or may be or may be included in a protrusion, and the second engaging member may include or may be or may be included in a recess.

According to various embodiments, the recess may be larger than the protrusion. According to various embodiments, the foot 104 may be held in any position (no matter whether attached to the housing 102 in the first way or the second way), and may be aligned by a circular recess near the first engaging member of the housing 102.

According to various embodiments, the recess may be configured to receive the protrusion in at least one of the first way or the second way.

According to various embodiments, the recess may be configured to receive the protrusion at least substantially completely in the first way, and the recess may further be configured to receive the protrusion at least substantially completely in the second way.

According to various embodiments, the foot 102 may be asymmetric.

According to various embodiments, the foot 102 may be configured to provide support for the center of gravity of the device 100 in the first orientation of the housing relative to the pre-determined portion of the foot when the first engaging member and the second engaging member engage in the first way. The foot 102 may further be configured to provide support for the center of gravity of the device 100 in the second orientation of the device relative to the pre-determined portion of the foot 102 when the first engaging member and the second engaging member engage in the second way.

According to various embodiments, the first engaging member and the second engaging member may be configured to engage using a friction force.

According to various embodiments, at least one of the first engaging member or the second engaging member may include or may be made from rubber (for example to increase the friction force).

According to various embodiments, the first engaging member and the second engaging member may be configured to engage using a magnetic force. For example, the both the first engaging member and the second engaging member may include magnets, which for example may be provided in opposing orientations, so as to attract each other.

According to various embodiments, at least one of the first engaging member or the second engaging member may include a soft material (for example to avoid scratches when attaching the foot 102 to the housing 104).

According to various embodiments, at least one of the first engaging member or the second engaging member may include a scratch preventing material.

According to various embodiments, at least one of the first engaging member or the second engaging member may include a sound damping material (for example to provide a nice sound when attaching the foot 102 to the housing 104).

According to various embodiments, the device 100 may be configured to stand on a surface using the foot 102 in any one orientation of the first engaging member and the second engaging member engaging in the first way or the first engaging member and the second engaging member engaging in the second way.

According to various embodiments, the foot 102 may be removable from the device 100.

According to various embodiments, the device 100 may be configured to stand on a surface using a portion of the housing 104 when the foot is removed from the device 100.

According to various embodiments, the foot 102 may include a lower surface (for example a surface on which the device 100 to which the foot 102 is attached stands) and an upper surface. The upper surface may be inclined with respect to the lower surface. The device 100 may be configured to stand on a surface using the lower surface. The first engaging member and the second engaging member may be configured to engage at least substantially proximal to the upper surface.

According to various embodiments, the upper surface may be at least substantially planar.

According to various embodiments, the lower surface may be at least substantially planar.

According to various embodiments, the lower surface may have at least substantially a shape of a polygon, a triangle, a rectangle, a square, an oval, an ellipse, or a circle.

According to various embodiments, the foot 102 may be interchangeable with a further foot. An inclination angle between the upper surface and the lower surface of the foot 102 may be different from an inclination angle of an upper surface and a lower surface of the further foot.

According to various embodiments, the first engaging member further may include an upper portion receiving portion configured to receive an upper portion of the foot 102. The device 100 may be configured to stand on a surface using a lower portion of the foot 102.

It will be understood that the device may have any number of feet, for example one foot, two feet, three feet, or any integer number of feet, and each foot may have a second engaging member and the housing may have a corresponding first engaging member, like exemplarily described for a foot 104.

Figure 1B:
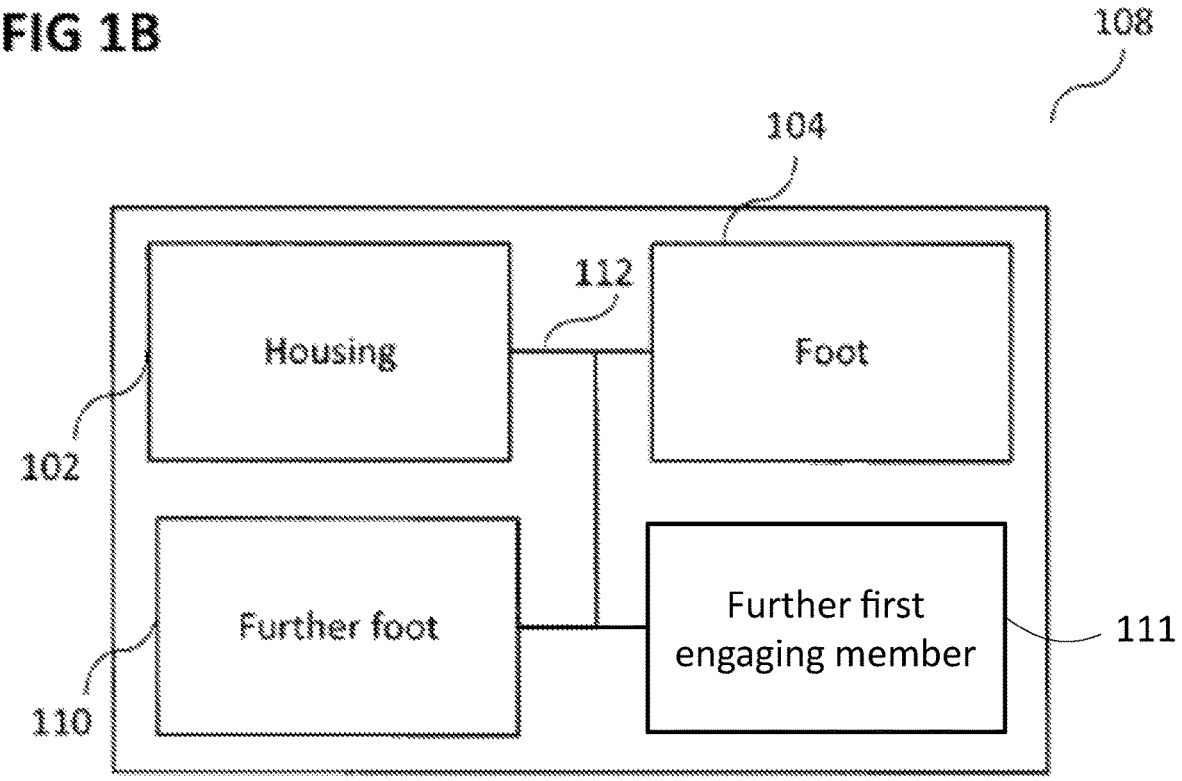

FIG. 1B shows a device 108 according to various embodiments. The device 108 may, similar to the device 100 of FIG. 1A, include a housing 102. The housing 102 may include a first engaging member (not shown in FIG. 1B). The device 108 may, similar to the device 100 of FIG. 1A, further include a foot 104. The foot 104 may include a second engaging member (not shown in FIG. 1B). The first engaging member and the second engaging member may be configured to engage (for example with each other) in a first way or in a second way. The device 108 may further include at least one further foot 110. The housing 102, the foot 104, and the further foot 110 may be coupled, like illustrated by line 112. When the first engaging member and the second engaging member engage in the first way, the housing 102 may have a first orientation relative to a pre-determined portion of the foot 104. When the first engaging member and the second engaging member engage in the second way, the housing 102 may have a second orientation relative to the pre-determined portion of the foot 104.

According to various embodiments, the at least one further foot 110 may include a further second engaging member (not shown in FIG. 1B). The housing 102 may further include at least one further first engaging member 111. The at least one further first engaging member and the at least one further second engaging member may be configured to engage in at least one of the first way or the second way.

According to various embodiments, the device 108 (or the device 100 as shown in FIG. 1A) may include or may be or may be included in a soundbar, a keyboard, a laptop, or a phone.

FIG. 2A, FIG. 2B, FIG. 3A, FIG. 3B, and FIG. 4 show illustrations of a loudspeaker according to various embodiments; throughout these illustrations, the same reference signs are used for the same portions, even though some portions may be seen from different angles of view.

Figure 2A:
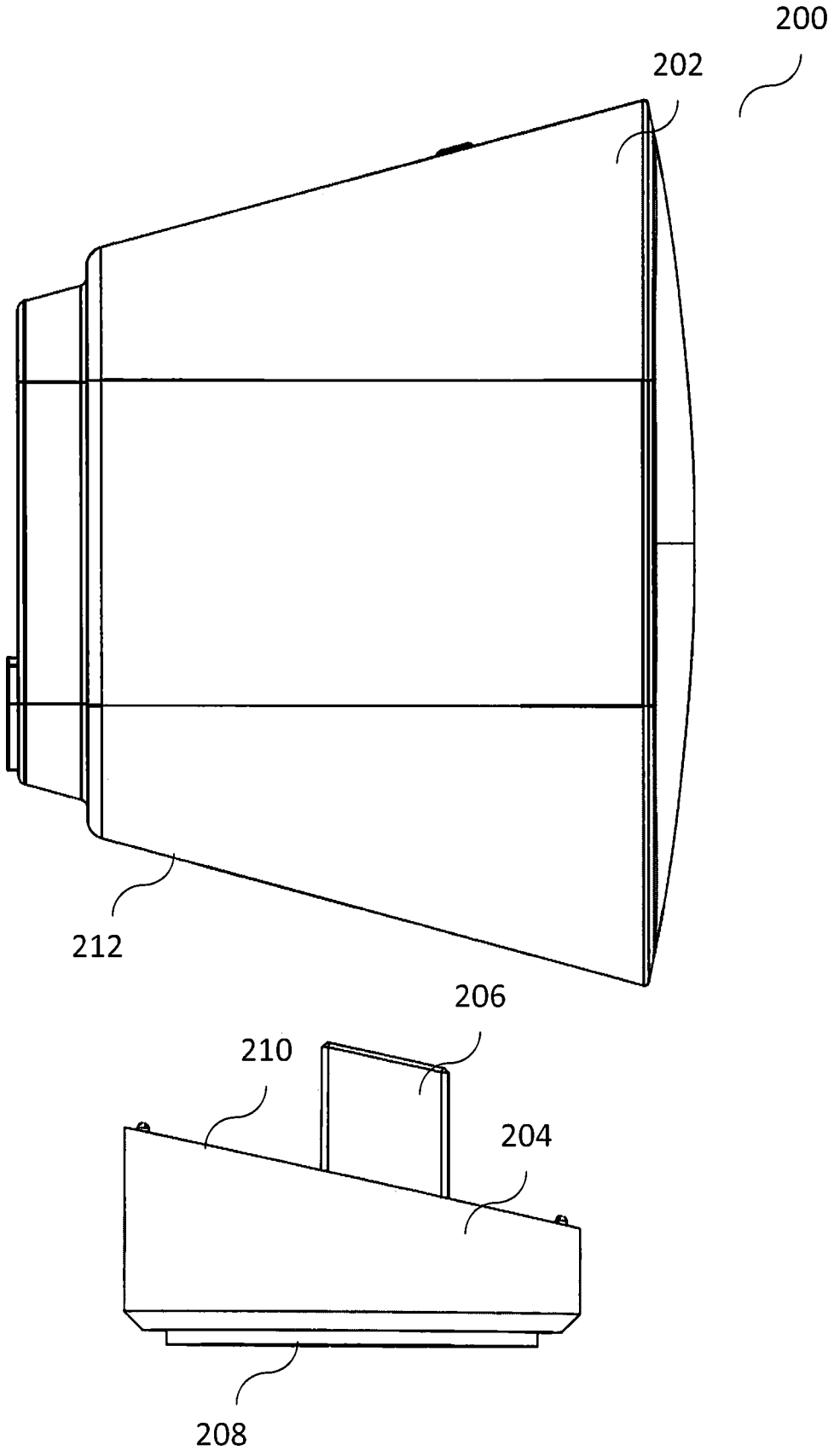
FIG. 2A, FIG. 2B, FIG. 3A, FIG. 3B, and FIG. 4 show illustrations of a loudspeaker according to various embodiments.

FIG. 2A shows an illustration 200 of a device (for example a loudspeaker) according to various embodiments. A housing 202 is shown, and a foot 204 is shown. The housing 202 may have a lower surface 212. The foot 204 may have an engaging member 206 (for example a second engaging member as described above; for example a protrusion). The foot 204 may furthermore have a lower surface 208 (on which it may stand), and an upper surface 210.

As illustrated in FIG. 2A, the lower surface 208 of the foot 204 and the upper surface 210 of the foot 204 may be non-parallel, but may be inclined towards each other. For example, the lower surface 208 may be defined by a first plane, and the first plane may be defined by a first direction (for example into the image plane) and a second direction (for example horizontally from left to right). The upper surface 210 may be defined by a second plane, and the second plane may be defined by a third direction (for example into the image plane) and a fourth direction (for example from upper left to lower right). The first plane and the second plane may not be parallel. However, the first direction and the third direction may be identical.

The housing 202 may rest on the foot 204 by resting the lower surface 212 of the housing 202 on the upper surface 210 of the foot 204. It will be understood that in order for the housing 202 to rest on the foot 204, the lower surface 212 of the housing 202 and the upper surface 210 of the foot 204 may be at least substantially parallel, and may at least substantially touch. FIG. 2A shows the housing 202 and the foot 204 disassembled, but aligned so as to properly fit together.

Figure 2B:
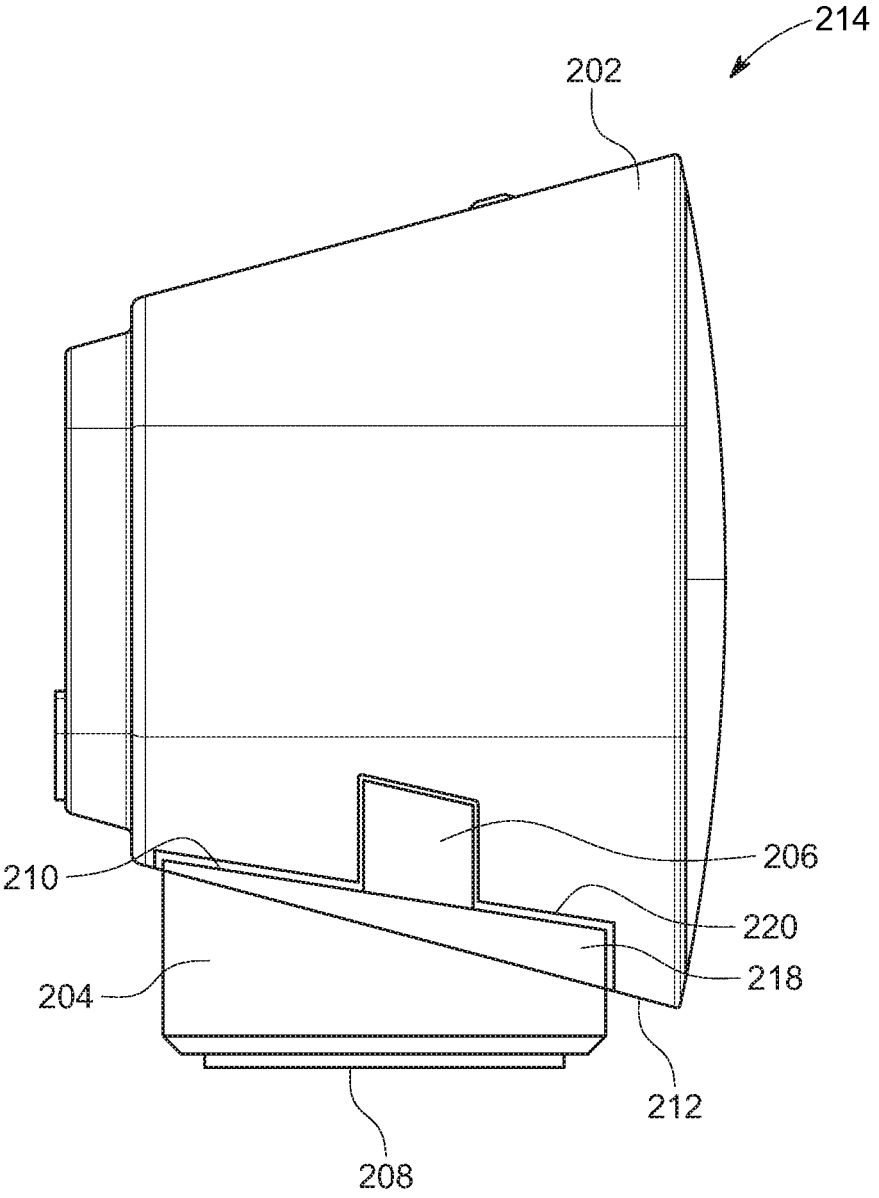

FIG. 2B shows an illustration 214, in which the foot 204 is attached the housing 202. As can be seen the recess 220 is larger than the protrusion such that the recess 220 is further configured to receive the protrusion 206 and a portion 218 of the foot 204 other than the protrusion 206 to align the foot 204 with the speaker housing 202.

Figure 3A:
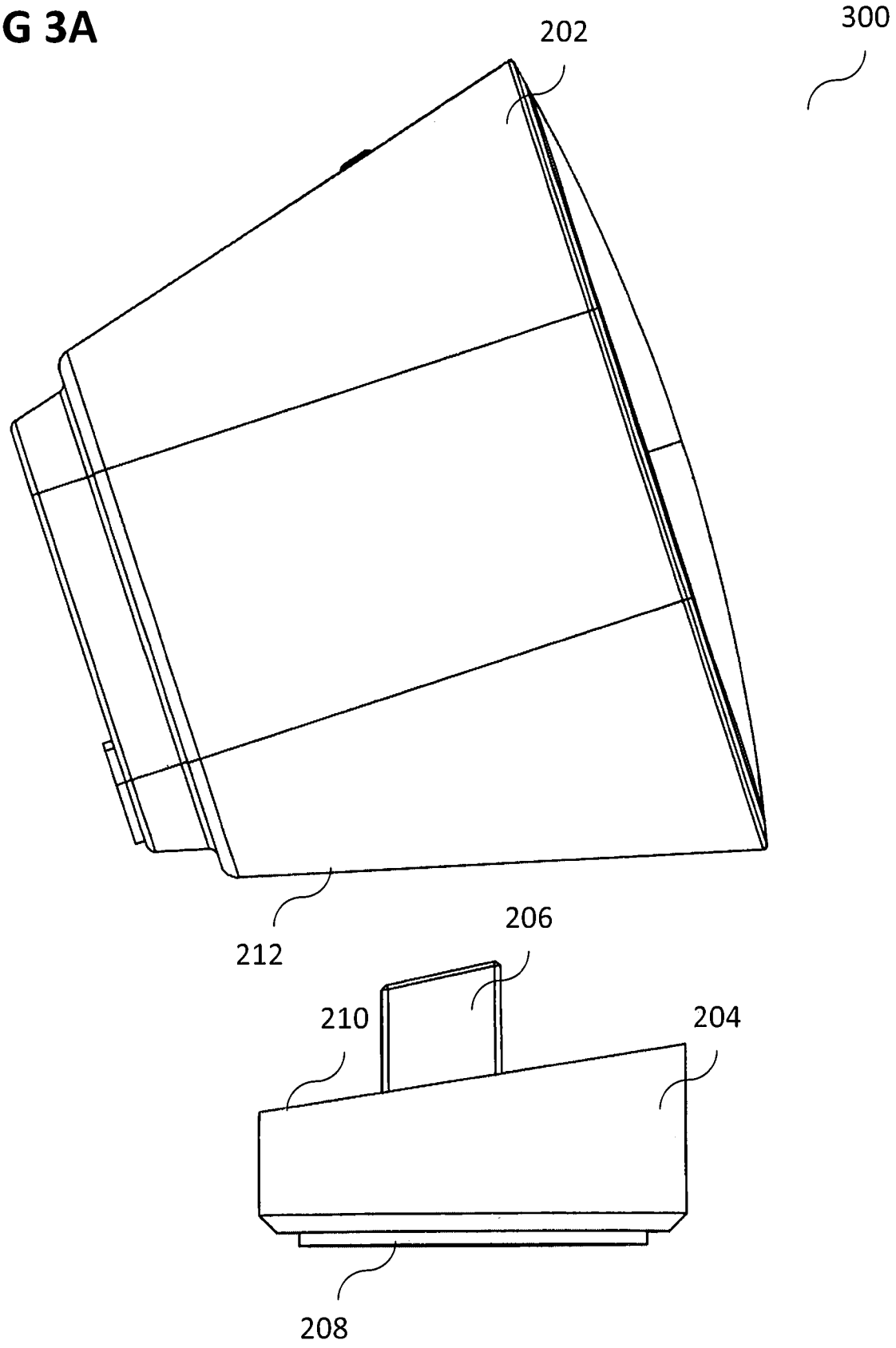

FIG. 3A shows an illustration 300 in which the housing 202 and the foot 204 are shown disassembled. Compared to FIG. 2A, the foot 204 has been rotated by at least substantially 180 degrees around the upwardly oriented axis. As such, due to the non-parallel lower surface 208 of the foot 204 and upper surface 210 of the foot 204, the inclination of the upper surface 210 when the foot 204 (in other words: the lower surface 208 of the foot 204) is resting on a horizontal surface, is from lower left to upper right (as compared to from upper left to lower right in FIG. 2A).

Furthermore, it can be seen that the protrusion 206 is not in the center of the foot 204. While in FIG. 2A the protrusion 206 is offset to the right from the center of the foot 204, by rotating the foot 204, the protrusion 206 as shown in FIG. 3A is offset to the left from the center of the foot 204. By having this not symmetric arrangement, a good weight balance may be achieved in any way (in other words: orientation) in which the foot 204 and the housing 202 (in other words: the first engaging member of the housing 202 and the second engaging member of the foot 204) engage.

FIG. 3A shows the housing 202 and the foot 204 disassembled, but aligned so as to properly fit together.

Figure 3B:
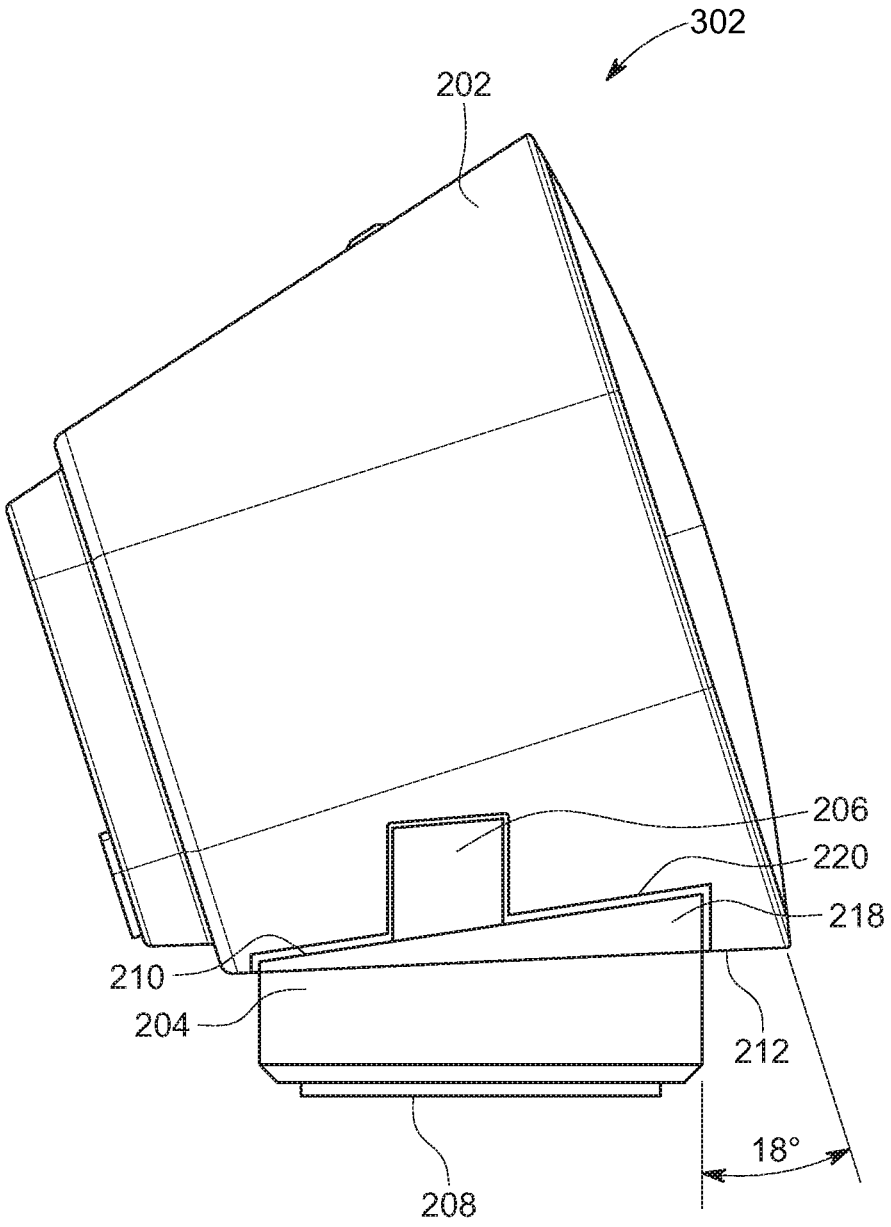

FIG. 3B shows an illustration 302, in which the foot 204 is attached to the housing 202. As can be seen, by turning the foot 204 and by thus changing the slope of the upper surface 210 of the foot 204, and by the (at least substantial) coinciding of the upper surface 210 of the foot 204 and the lower surface 212 of the housing 202, the orientation of the housing 202 has changed compared to what is shown in FIG. 2B (for example by 18 degrees). The recess 220 is larger than the protrusion such that the recess 220 is further configured to receive the protrusion 206 and a portion 218 of the foot 204 other than the protrusion 206 to align the foot 204 with the speaker housing 202.

Figure 4:
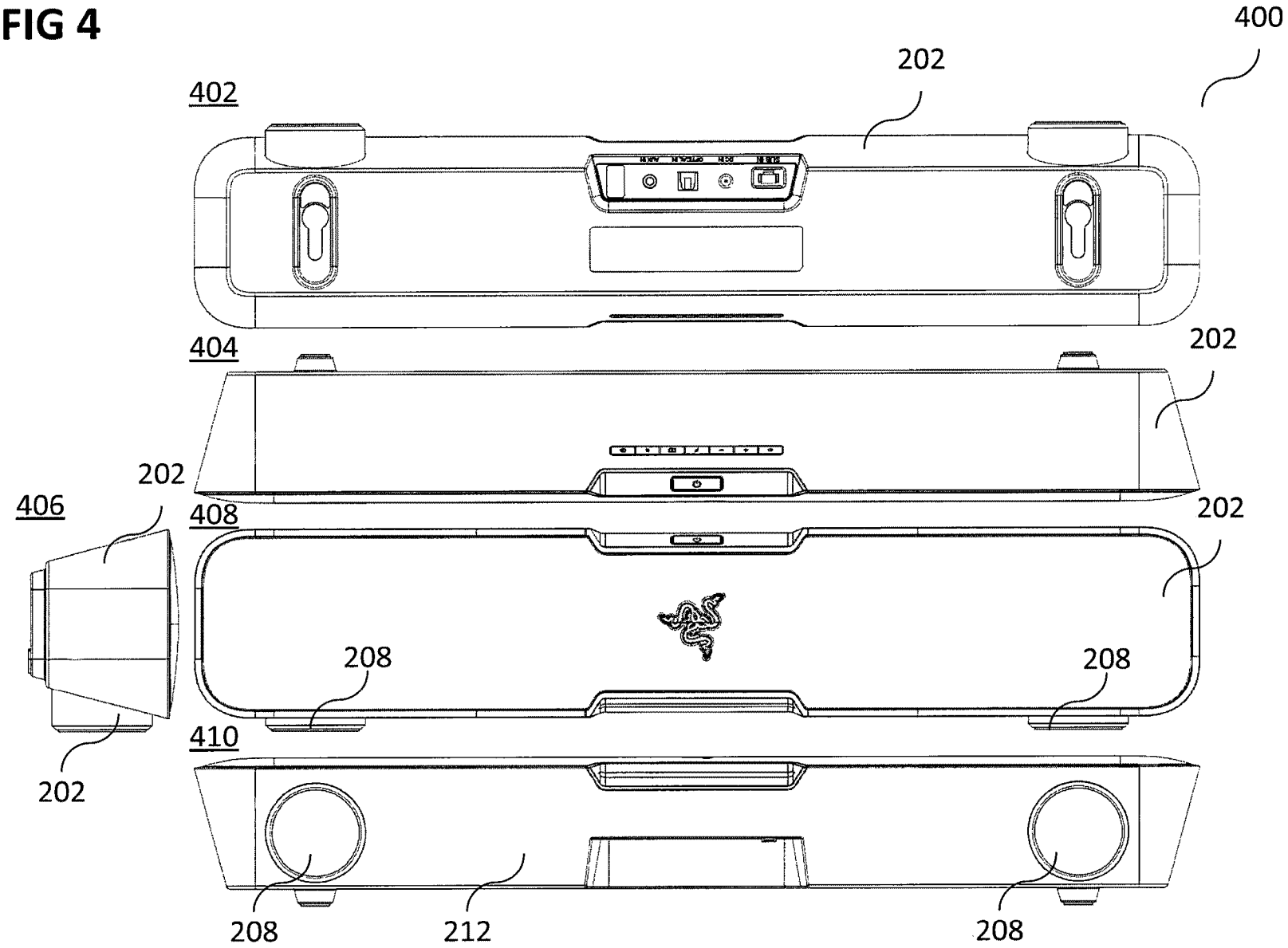

FIG. 4 shows an illustration 400 of different views of a soundbar with a housing and two feet according to various embodiments. A rear view 402, a top view 404, a side view 406, a front view 408, and a bottom view 410 are shown.

Figure 5A:
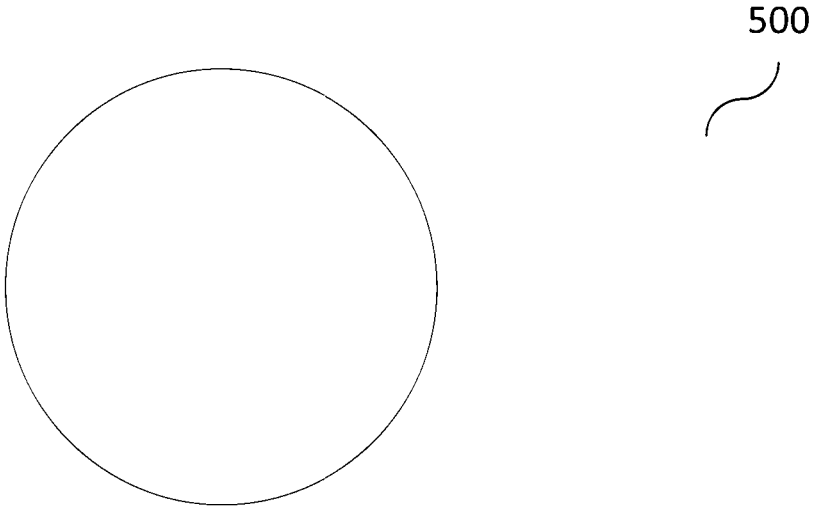
FIG. 5A, FIG. 5B, and FIG. 5C show illustrations of feet according to various embodiments.
Figure 5B:
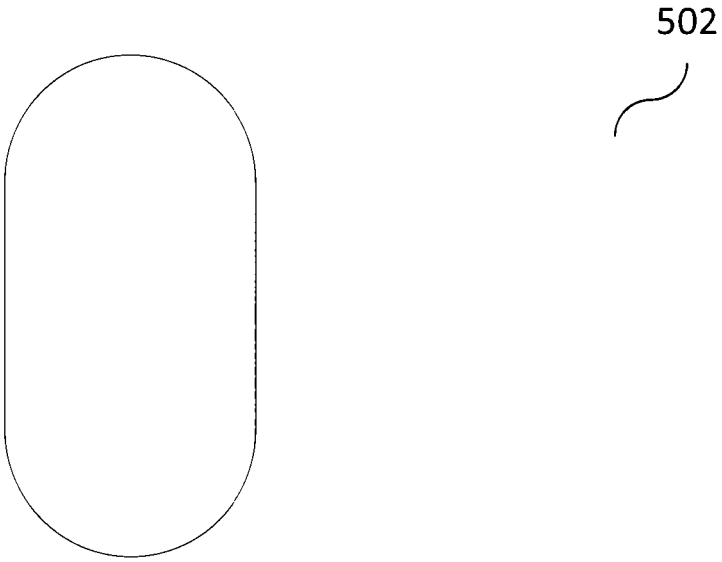
Figure 5C:
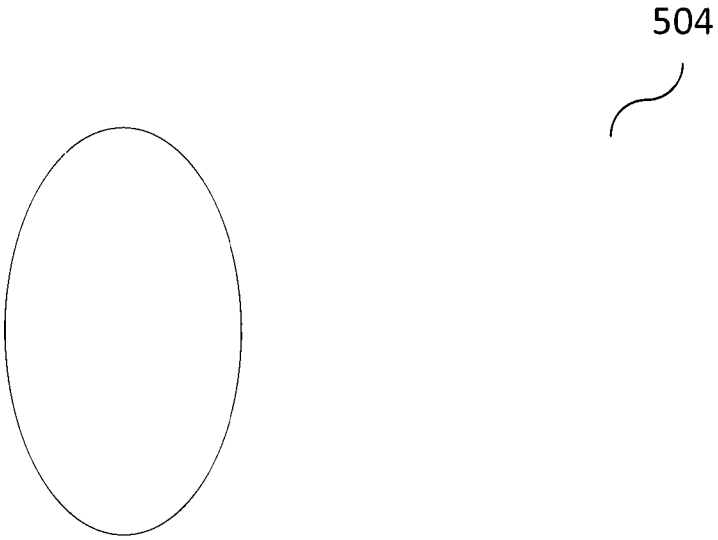

FIG. 5A, FIG. 5B, and FIG. 5C show illustrations of feet (seen from below, i.e. what is shown are lower surfaces of the feet) according to various embodiments. In FIG. 5A, a foot 500 with a circular lower surface is shown. In FIG. 5B, a foot 502 with an elongated lower surface is shown. In FIG. 5C, a foot 504 with an ellipsoidal lower surface is shown.

The following examples pertain to further embodiments:

Example 1 is a device comprising: a housing comprising a first engaging member; a foot comprising a second engaging member; wherein the first engaging member and the second engaging member are configured to engage in at least one of a first way or a second way; wherein when the first engaging member and the second engaging member engage in the first way, the housing has a first orientation relative to a pre-determined portion of the foot; wherein when the first engaging member and the second engaging member engage in the second way, the housing has a second orientation relative to the pre-determined portion of the foot.

In example 2, the subject-matter of example 1 can optionally include that the first engaging member and the second engaging member engaging in the first way comprises the first engaging member and the second engaging member engaging in a first relative orientation; and that the first engaging member and the second engaging member engaging in the second way comprises the first engaging member and the second engaging member engaging in a second relative orientation.

In example 3, the subject-matter of example 2 can optionally include that in the second relative orientation, the foot is rotated by about at least substantially 180 degrees compared to the first relative orientation.

In example 4, the subject-matter of any one of examples 1 to 3 can optionally include that the first engaging member comprising a recess; and that the second engaging member comprises a protrusion.

In example 5, the subject-matter of example 4 can optionally include that the recess is larger than the protrusion.

In example 6, the subject-matter of any one of examples 4 to 5 can optionally include that the recess is configured to receive the protrusion in at least one of the first way or the second way.

In example 7, the subject-matter of any one of examples 4 to 6 can optionally include that the recess is configured to receive the protrusion at least substantially completely in the first way; and that the recess is configured to receive the protrusion at least substantially completely in the second way.

In example 8, the subject-matter of any one of examples 1 to 7 can optionally include that the first engaging member comprising a protrusion; and that the second engaging member comprises a recess.

In example 9, the subject-matter of example 8 can optionally include that the recess is larger than the protrusion.

In example 10, the subject-matter of any one of examples 8 to 9 can optionally include that the recess is configured to receive the protrusion in at least one of the first way or the second way.

In example 11, the subject-matter of any one of examples 8 to 10 can optionally include that the recess is configured to receive the protrusion at least substantially completely in the first way; and that the recess is configured to receive the protrusion at least substantially completely in the second way.

In example 12, the subject-matter of any one of examples 1 to 11 can optionally include that the foot is asymmetric.

In example 13, the subject-matter of any one of examples 1 to 12 can optionally include that the foot is configured to provide support for the center of gravity of the device in the first orientation of the housing relative to the pre-determined portion of the foot when the first engaging member and the second engaging member engage in the first way; and that the foot is configured to provide support for the center of gravity of the device in the second orientation of the device relative to the pre-determined portion of the foot when the first engaging member and the second engaging member engage in the second way.

In example 14, the subject-matter of any one of examples 1 to 13 can optionally include that the first engaging member and the second engaging member are configured to engage using a friction force.

In example 15, the subject-matter of any one of examples 1 to 14 can optionally include that at least one of the first engaging member or the second engaging member comprises rubber.

In example 16, the subject-matter of any one of examples 1 to 15 can optionally include that the first engaging member and the second engaging member are configured to engage using a magnetic force.

In example 17, the subject-matter of any one of examples 1 to 16 can optionally include that at least one of the first engaging member or the second engaging member comprises a soft material.

In example 18, the subject-matter of any one of examples 1 to 17 can optionally include that at least one of the first engaging member or the second engaging member comprises a scratch preventing material.

In example 19, the subject-matter of any one of examples 1 to 18 can optionally include that at least one of the first engaging member or the second engaging member comprises a sound damping material.

In example 20, the subject-matter of any one of examples 1 to 19 can optionally include that the device is configured to stand on a surface using the foot in any one orientation of the first engaging member and the second engaging member engaging in the first way or the first engaging member and the second engaging member engaging in the second way.

In example 21, the subject-matter of any one of examples 1 to 20 can optionally include that the foot is removable from the device.

In example 22, the subject-matter of example 21 can optionally include that the device is configured to stand on a surface using a portion of the housing when the foot is removed from the device.

In example 23, the subject-matter of any one of examples 1 to 22 can optionally include that the foot comprises a lower surface and an upper surface, wherein the upper surface is inclined with respect to the lower surface; that the device is configured to stand on a surface using the lower surface; and that the first engaging member and the second engaging member are configured to engage at least substantially proximal to the upper surface.

In example 24, the subject-matter of example 23 can optionally include that the upper surface is at least substantially planar.

In example 25, the subject-matter of any one of examples 23 to 24 can optionally include that the lower surface is at least substantially planar.

In example 26, the subject-matter of example 25 can optionally include that the lower surface has at least substantially a shape of one of a polygon, a triangle, a rectangle, a square, an oval, an ellipse, or a circle.

In example 27, the subject-matter of any one of examples 23 to 26 can optionally include that the foot is interchangeable with a further foot; and that an inclination angle between the upper surface and the lower surface of the foot is different from an inclination angle of an upper surface and a lower surface of the further foot.

In example 28, the subject-matter of any one of examples 1 to 27 can optionally include that the first engaging member further comprises an upper portion receiving portion configured to receive an upper portion of the foot; and that the device is configured to stand on a surface using a lower portion of the foot.

In example 29, the subject-matter of any one of examples 1 to 28 can optionally include: at least one further foot comprising a further second engaging member; wherein the housing further comprises at least one further first engaging member; wherein the at least one further first engaging member and the at least one further second engaging member are configured to engage in at least one of the first way or the second way.

In example 30, the subject-matter of any one of examples 1 to 29 can optionally include that the device comprises at least one of a soundbar, a keyboard, a laptop, or a phone.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A speaker comprising:

a speaker housing comprising a recess; and a foot comprising a protrusion, wherein the recess is configured to receive the protrusion at least substantially completely in one of a first way or a second way, wherein when the recess receives the protrusion at least substantially completely in the first way, the speaker housing has a first orientation relative to a pre-determined portion of the foot, wherein when the recess receives the protrusion at least substantially completely in the second way, the speaker housing has a second orientation relative to the pre-determined portion of the foot, wherein a center of the protrusion on a horizontal axis being offset horizontally to a side of a center of the foot on the horizontal axis causes weight balance to be achieved when the recess receives the protrusion at least substantially completely in the first way, and when the recess receives the protrusion at least substantially completely in the second way, wherein the recess is larger than the protrusion such that the recess is further configured to receive the protrusion and a portion of the foot to align the foot with the speaker housing.

2. The speaker of claim 1, wherein the recess receiving the protrusion at least substantially completely in the first way comprises the recess and the protrusion engaging in a first relative orientation; and wherein the recess receiving the protrusion at least substantially completely in the second way comprises the recess and the protrusion engaging in a second relative orientation.

3. The speaker of claim 2, wherein in the second relative orientation, the foot is rotated by about at least substantially 180 degrees compared to the first relative orientation.

4. The speaker of claim 1, wherein the foot is asymmetric.

5. The speaker of claim 1, wherein the recess and the protrusion are configured to engage using at least one of a friction force or a magnetic force.

6. The speaker of claim 1, wherein at least one of the recess or the protrusion comprises at least one of a rubber, a soft material, a scratch preventing material or a sound damping material.

7. The speaker of claim 1, wherein the speaker is configured to stand on a surface using the foot, in any one orientation of the recess and the protrusion engaging in the first way or the recess and the protrusion engaging in the second way.

8. The speaker of claim 1, wherein the foot comprises a lower surface and an upper surface, wherein the upper surface is inclined with respect to the lower surface;

wherein the speaker is configured to stand on a surface using the lower surface; and wherein the recess and the protrusion are configured to engage at least substantially proximal to the upper surface.

9. The speaker of claim 8, wherein at least one of the upper surface or the lower surface is at least substantially planar.

10. The speaker of claim 9, wherein the lower surface has at least substantially a shape of one of a polygon, a triangle, a rectangle, a square, an oval, an ellipse, or a circle.

11. The speaker of claim 8, wherein the foot is interchangeable with a further foot;

wherein an inclination angle between the upper surface and the lower surface of the foot is different from an inclination angle of an upper surface and a lower surface of the further foot.

12. The speaker of claim 1, wherein the speaker is configured to stand on a surface using a lower portion of the foot.

* * * * *